US010294661B2

(12) United States Patent
Johnson

(10) Patent No.: US 10,294,661 B2
(45) **Date of Patent: *May 21, 2019**

(54) LATH AND DRAINAGE

(71) Applicant: INNOVATION CALUMET LLC, Valparaiso, IN (US)

(72) Inventor: Gary R. Johnson, Gary, IN (US)

(73) Assignee: Innovation Calumet LLC, Valparaiso, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/682,467

(22) Filed: Aug. 21, 2017

(65) Prior Publication Data

US 2018/0195277 A1 Jul. 12, 2018

Related U.S. Application Data

(63) Continuation of application No. 15/159,762, filed on May 19, 2016, now Pat. No. 9,739,056, which is a continuation of application No. 14/842,471, filed on Sep. 1, 2015, now Pat. No. 9,366,033, which is a continuation of application No. 13/848,993, filed on Mar. 22, 2013, now Pat. No. 9,127,467.

(60) Provisional application No. 61/614,673, filed on Mar. 23, 2012.

(51) Int. Cl.

| | |
|---|---|
| ***E04F 13/04*** | (2006.01) |
| ***E04B 2/84*** | (2006.01) |
| ***E04F 13/08*** | (2006.01) |
| ***E04B 1/66*** | (2006.01) |
| ***E04B 1/70*** | (2006.01) |

(52) U.S. Cl.

CPC ..... *E04B 2/845* (2013.01); *E04B 1/665* (2013.01); *E04B 1/7038* (2013.01); *E04F 13/04* (2013.01); *E04F 13/047* (2013.01); *E04F 13/08* (2013.01); *Y10T 428/249962* (2015.04)

(58) Field of Classification Search

CPC ..... E04B 2/845; E04B 1/665; E04B 1/7038; E04F 13/04; E04F 13/047; E04F 13/08; Y10T 428/249962

See application file for complete search history.

(56) References Cited

U.S. PATENT DOCUMENTS

| | | | | | |
|---|---|---|---|---|---|
| 1,767,565 | A * | 6/1930 | Thrift | E04F 13/045 | 411/475 |
| 2,864,251 | A * | 12/1958 | Imbrogno, Jr. | E04B 1/76 | 165/49 |
| 5,287,673 | A * | 2/1994 | Kreikemeier | E04F 13/04 | 52/663 |
| 5,481,843 | A * | 1/1996 | Kreikemeier | E04F 13/04 | 52/663 |
| 5,826,388 | A * | 10/1998 | Irving | E04B 1/7612 | 52/302.1 |
| RE36,676 | E * | 5/2000 | Sourlis | E04B 1/644 | 52/169.5 |
| 6,131,353 | A * | 10/2000 | Egan | B32B 5/02 | 52/408 |
| 6,355,333 | B1 * | 3/2002 | Waggoner | E04B 1/62 | 428/174 |

(Continued)

*Primary Examiner* — Beth A Stephan

(74) *Attorney, Agent, or Firm* — McDonnell Boehnen Hulbert & Berghoff LLP

(57) ABSTRACT

An improved lath is disclosed having a water drainage layer provided in association with the lath. The water drainage layer serves to remove water that might otherwise build up between the lath and wall structure.

20 Claims, 3 Drawing Sheets

(56) References Cited

U.S. PATENT DOCUMENTS 6,594,965 B2 * 7/2003 Coulton ..... E04B 1/7046 52/302.1
6,761,006 B2 * 7/2004 Lubker, II ..... B32B 5/12 52/302.1
6,786,013 B2 * 9/2004 Coulton ..... B32B 3/28 405/45
6,869,901 B2 * 3/2005 Lubker, II ..... B32B 5/12 442/208
6,990,775 B2 * 1/2006 Koester ..... E04B 1/70 428/121
7,287,356 B2 * 10/2007 Sacks ..... E04O 5/04 52/342
7,343,716 B2 * 3/2008 Nordgren ..... B32B 3/266 52/506.01
7,520,097 B2 * 4/2009 Aalbers ..... B32B 27/12 52/302.1
7,584,581 B2 * 9/2009 Iske ..... E02D 19/18 405/229
7,757,447 B2 * 7/2010 Aalbers ..... B32B 27/12 52/302.1
7,902,092 B2 * 3/2011 Egan ..... D03D 1/00 442/2
7,908,801 B2 * 3/2011 Nielsen ..... B32B 3/30 405/36
2002/0108333 A1 * 8/2002 Clayton ..... E04B 1/70 52/302.1
2004/0074184 A1 * 4/2004 Naji ..... C04B 28/02 52/344
2006/0101758 A1 * 5/2006 Egan ..... E04F 13/0885 52/408
2007/0051069 A1 * 3/2007 Grimes ..... E04B 1/7069 52/782.1
2007/0175145 A1 * 8/2007 Sacks ..... B21F 27/20 52/408
2007/0261365 A1 * 11/2007 Keene ..... E04F 13/04 52/796.1
2009/0031656 A1 * 2/2009 Hunt-Hansen ..... E04F 13/04 52/344
2012/0216481 A1 * 8/2012 Hunt-Hansen ..... E04F 13/04 52/741.3
2012/0304565 A1 * 12/2012 Hines ..... E04F 13/04 52/302.1

* cited by examiner

LATH AND DRAINAGE

CROSS-REFERENCE TO RELATED APPLICATIONS

The present application is a continuation of U.S. application Ser. No. 15/159,762, filed on May 19, 2016, which is a continuation of U.S. application Ser. No. 14/842,471, filed on Sep. 1, 2015, which is a continuation of U.S. application Ser. No. 13/848,993, filed on Mar. 22, 2013, which claims priority from U.S. Provisional Application No. 61/614,673, filed Mar. 23, 2012, all of which are incorporated by reference herein in their entirety.

FIELD OF THE INVENTION

This invention generally relates to lath, and more particularly to an integrated drainage system with lath for use in stone, or thin brick, veneer and stucco.

BACKGROUND

The use of hard coat stucco has been employed as a building material since literally ancient days. For stucco and plaster applications, a lath or mesh is typically applied to the surface of the wall or ceiling structure. This provides mechanical holding or keying for the unhardened stucco or plaster. Metal lath is often used as the reinforcement when stucco or plaster is applied over open frame construction, sheathed frame construction, or a solid base having a surface that might otherwise provide an unsatisfactory bond for the stucco or plaster. When applied over frame construction, one may employ base coats of plaster with a total thickness of approximately ⅜ inch to approximately ¾ inch to produce a solid base for a decorative finish coat. Metal lath reinforcement is also recommended for the application of stucco and plaster to old concrete or masonry walls, especially if the surface is lacking in compatibility with the base layer. There are also plastic laths available for the same purpose as metal lath.

According to the International Conference of Building Officials Acceptance Criteria for Cementitious Exterior Wall Coatings, AC 11, effective Oct. 1, 2002, and evaluation report NER-676, issued Jul. 1, 2003, wire fabric lath should be a minimum of No. 20 gauge, 1 inch (25.4 mm) (spacing) galvanized steel woven-wire fabric. The lath should be self-furred, or furred when applied over all substrates except unbacked polystyrene board. Metal lath has structural integrity, but if made of steel can corrode over time. The metal can also unfavorably react with the chemistry of the plaster or stucco. Hence, plastic or non-metal lath has gained popularity.

Stone veneer has also gained in popularity. Mounting of stone veneer using lath can present similar issues to that of plaster and stucco. A concern with the stone veneer, and even stucco, is that moisture can find its way behind the outer stone or stucco surface. This can present itself by way of hole penetrations in putting up the lath, and water condensing or otherwise migrating behind the lath.

SUMMARY

In one aspect of the invention, a matrix of randomly oriented plastic or other durable fibers which are relatively rigid, or which can be treated to be relatively rigid or organized into a matrix that is relatively rigid, is employed as the lath. An example of the foregoing kind of material is sold under the name MORTAR NET, sold by Mortar Net, Inc. of Burns Harbor, Ind., and such as disclosed in U.S. Pat. No. Re. 36,676. Such a matrix lath would preferably be on the order of around except ¼" thick (in front to back width). The matrix lath would preferably be provided in large sheets or rolls having substantial length and height.

In this embodiment, preferably affixed to the matrix lath, as by bonding thereto, is a layer that will form a water channel layer and spacer inboard to the matrix lath. In one form, this water channel layer is of a material similar to that of the foregoing matrix lath, but of a smaller fibrous diameter entangled randomly oriented plastic or other durable fiber, formed in a thinner width, such as 3/16" or ¼" WALLNET product, which is made and sold under that name by Mortar Net, Inc. from stock material made by the Fiber Bond Corporation. WALLNET is an airlaid, nonwoven media composed of polyester fibers bonded with a blend of PVC polymers and an anti-microbial, with a general weight of about 3.5 oz/yd2. This water channel layer is of similar length and height as that of the matrix lath. While this water channel layer is preferably joined to the matrix lath in some manner, it could be separate in use.

Additionally, although not necessarily, a further layer of material may be provided in the form of a thin scrim that would be between the matrix lath and the water channel face outward from the structure. The scrim layer is much more tightly structured, preferably non-woven, but is water permeable. It is of like length and height as the matrix lath and water channel layer. The scrim adds some further integrity to the construct, it acts as an insect barrier, and provides additional protection against mortar clogging the water channel layer.

In use, the foregoing embodiment of matrix lath and water channel layer, including scrim if desired, is affixed to an inner wall structure, as by nailing or screwing thereto, with the water channel layer most inboard and against the wall structure. Plaster can be applied to the matrix lath in a standard manner of application. The water layer forms a drainage plane that allows water which may have penetrated cracks in the stucco or between the mortar and veneer, to drain out; such water incursion is normal in brick construction that creates the need for a cavity wall construction. Effectively, the water channel layer functions as a cavity filled with mesh. Water is effectively blocked from entering the structure, however, and drains vertically downward through the mesh of the water channel layer, to exit the wall at the bottom, as being drained through weep holes or the like. The water exit at the bottom might be accomplished by having a layer at the bottom of the wall with drainage channels similar to that shown in U.S. Pat. Nos. 7,543,413 and 7,543,414.

In an alternative embodiment, a thin sheet of plastic thermoformed to have features to capture mortar, not unlike metal lath, may be provided for the water channel layer. This could be an open-weave type material that is formed with corrugations or projections extending from what would be the plane of the material.

In a further embodiment, the lath is spaced from the water layer (with or without scrim layer), through the use of spacers, such as soft foamacious elements. The spacers themselves may also act as receptacles for the screws or nails used to put up the lath. In this way, the foam material serves to "seal" the penetrations made in the wall structure. The spacers can also be arranged in a manner to catch debris falling behind the lath, while still allowing water to pass.

The spacers could be arranged as blocks spaced laterally from one another, of any desired shape (rectangle, circle, etc.).

In another embodiment, a combination of spacers and scrim is contemplated. In this version, a non-woven scrim material is provided with integral thermoplastic bumps affixed thereto over a surface. The bumps may be a rubber or other somewhat flexible material, for instance, which can serve not only a stand-off function, but also receive a nail or other fixation device through the bump, thus yielding a self-sealing function.

Additionally, a water or vapor barrier can further be provided as the innermost (inboard) layer of the construct.

In an embodiment, the foregoing combination of flexible fibrous or matrix lath, spacers, water channel layer, with or without scrim and/or vapor barrier, can be made unified, and provided as a more or less continuous roll stock material. An installer thus would only need to "cut to size" for the application.

DETAILED DESCRIPTION

Figure 1A:
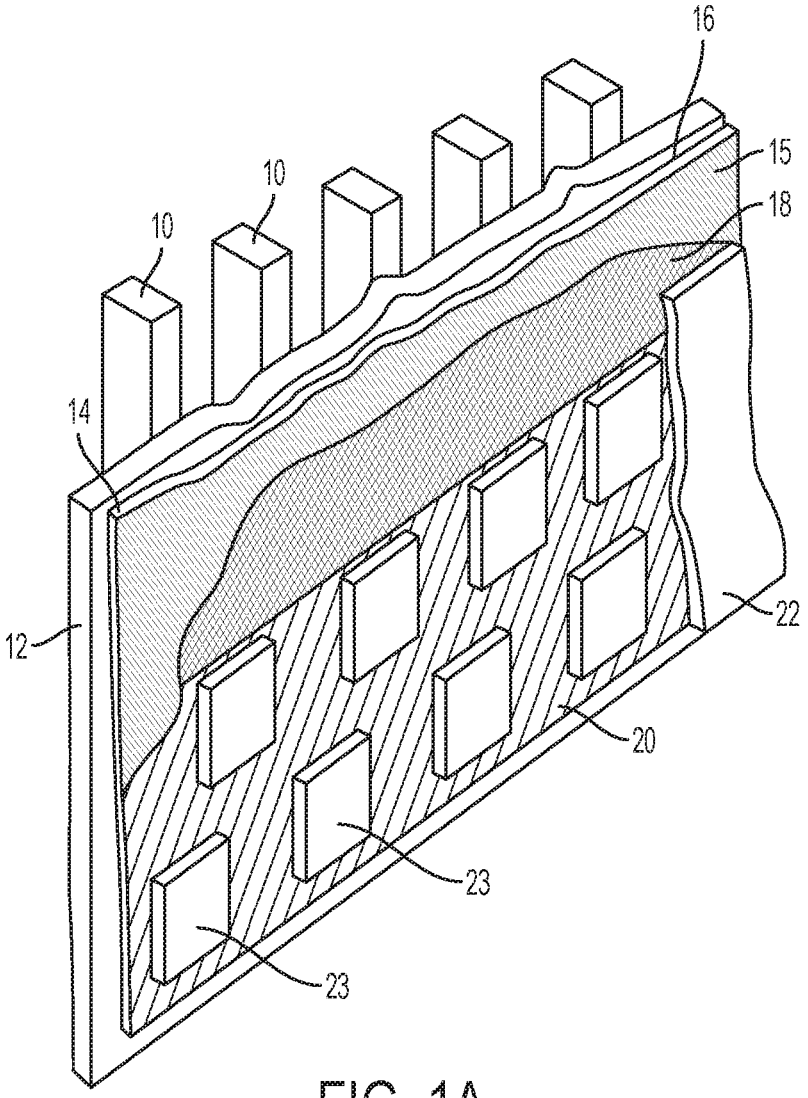
FIG. 1A is a perspective view of a wall structure with a lath and water channeling construct made in accordance with the invention.
Figure 1B:
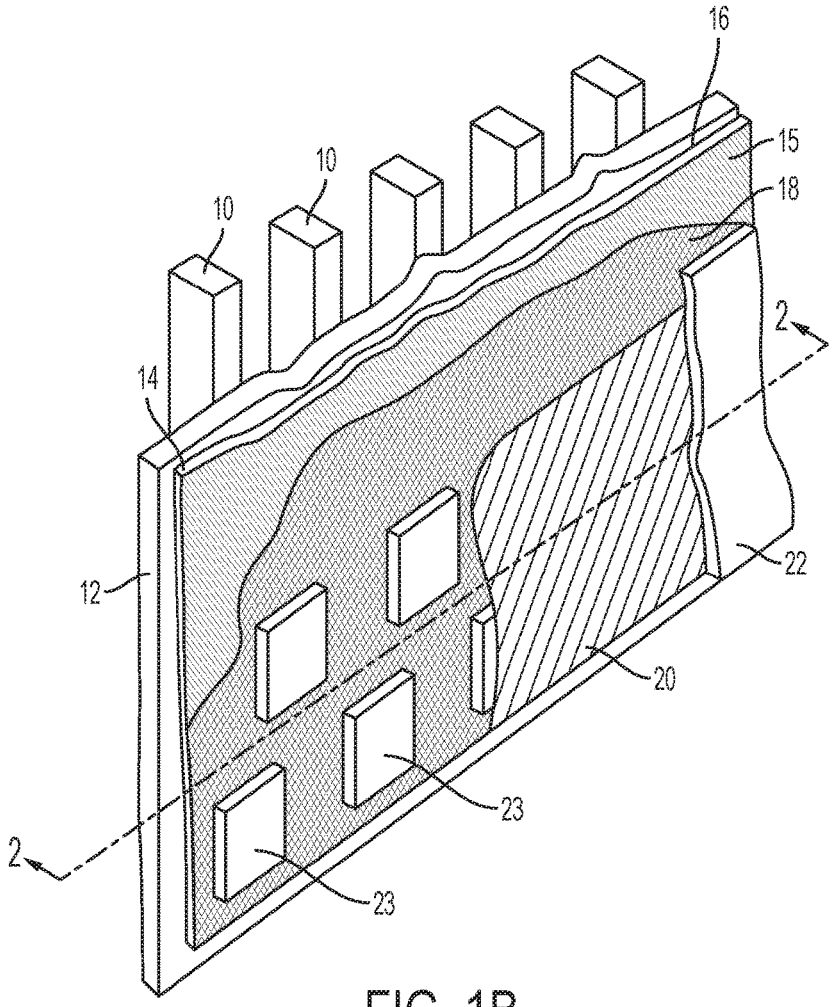
FIG. 1B is another perspective view of a wall structure with a lath and water channeling construct made in accordance with the invention.
Figure 2:
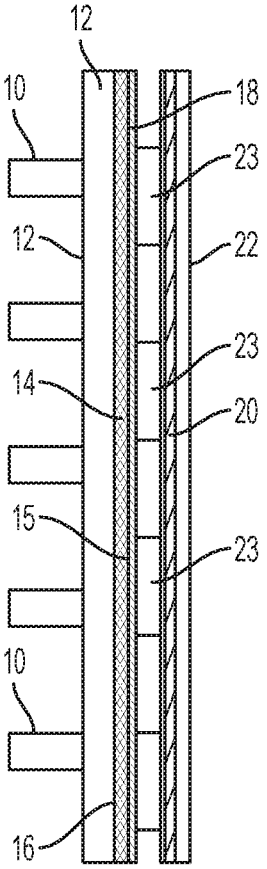
FIG. 2 is a sectional view taken along line 2-2 of FIG. 1B.

Referring now to FIGS. 1B and 2 in particular, a construct in the form of a structural support for plaster, stucco and stone veneer is disclosed. A typical wall is shown, being formed of studs 10 to which a wallboard or wood sheathing 12 is attached in well-known manner.

Outboard of the wallboard 12 (inboard being toward the studs 10), is a water channel material 14. In this embodiment, the water channel material is a fibrous mesh or matrix made up of thin plastic filaments or fibers. Such a material is sold by Mortar Net, Inc. under the name WALLNET. Here, the material is about ¼ inch to about ½ inch thick in width (width being measured normal to the substantially planer front side 15 and backside 16 of the water channel material 14). The water channel material thus generally fills the width defined between front side 15 and backside 16, forming a circuitous pathway for water that may then flow therebetween. The water channel material nonetheless can catch and hold debris that might fall thereon from above, without clogging the water channel thereby provided.

If desired, a vapor barrier layer (not shown) may be provided inboard of the water channel material, against the wallboard. This could be a plastic sheet, or a spray-on vapor barrier.

Next outboard from the water channel material 14 is an optional scrim 18.

Scrim 18 is a non-woven sheet material in this embodiment which permits air and water to pass therethrough, but can provide some additional support and serve as a barrier to tiny insects.

A lath material 20 is provided. There are many known types of lath, including metal and plastic being most commonly used. The lath serves as the main supporting structure for receiving and holding plaster or stucco, or some cementitious or other adhesive compound for holding stone veneer 22, for instance.

In this embodiment, spacers 23 are used between the lath 20 and the scrim/water channel material. The spacers 23 may advantageously be glued or otherwise adhered to one or both of the layers on either side thereof. Spacers 23 are made of a soft foam material, which provides a self-sealing barrier for water when nails, screws or the like are driven through the spacers, so as to mount the lath 20 to the wallboard 12.

It will be understood that some of the foregoing elements need not be employed in the exact order shown in FIGS. 1B and 2. The elements may be employed, for example, in the order shown in FIG. 1A.

Note that one of the advantages of the present invention is that the construct of water channel material 14, spacers 23 and lath 20, with or without scrim 18, with or without vapor barrier, can be provided as a unitary whole. Especially advantageous is to make the construct as a roll stock material, so that a builder may simply unroll the amount desired and "cut to size," more or less.

Figure 3:
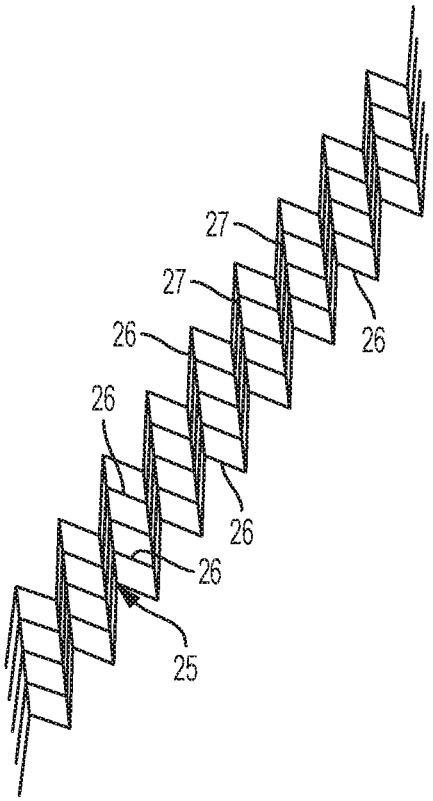
FIG. 3 is a view of a corrugated lath material.

FIG. 3 shows a type of material 25 that could be used as a lath material in this application. Here, it is a filamentous plastic having thin diameter elements 26 that run roughly parallel to one another, which are joined by other elements 27 that cross therebetween. The elements 26, 27 having sufficient rigidity to be formed into a somewhat corrugated surface having peaks and valleys. The material is open, so as to receive plaster, stucco, or other cementitious or adhesive material therein, and thereby serve the function of lath.

Figure 4:
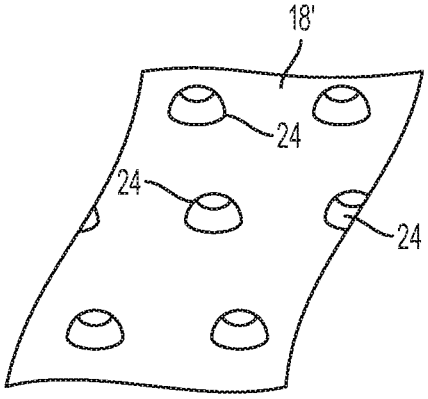
FIG. 4 is a perspective view of a scrim material with stand-off elements.

FIG. 4 shows a variation on the scrim 18, which is here provided with integral stand-off elements or bosses. Scrim 18' is as previously described, being a high loft non-woven thin material. This could also be some other material, whether non-woven or not. Attached to scrim 18' are the bosses or bumps 24, which are affixed to one side of the scrim, as by bonding thereto. These bosses 24 may be made of a material that can readily receive a nail, screw or the like, and thereby attach the scrim in a manner whereby the fastener is self-sealed by the boss through which it passes. A rubber or rubber-like material may be used, or some softer thermoplastic, just to name two examples. The combination of scrim plus stand-off elements may have good advantage in field application.

Thus, while the present invention has been described with respect to a certain embodiment, numerous changes and modifications will be apparent to those of skill in the art, and such changes and modifications are intended to be encompassed within the spirit of the invention, as defined by the claims.

What is claimed is:

1. A construct for drainage and structural support of a wall, the construct comprising:

a matrix lath having a front side, a back side, a first plurality of filamentous elements arranged in a first direction, and a second plurality of filamentous elements arranged in a second direction substantially perpendicular to the first direction, wherein the first plurality of filamentous elements and the second plurality of filamentous elements together form a surface having peaks and valleys; and a water channel layer having a front side and a back side, wherein the front side of the water channel layer is joined with the back side of the matrix lath, and wherein the water channel layer is formed from a matrix of randomly oriented, non-absorbent, fibrous elements that define a path for water passing through the water channel layer from a top to a bottom thereof.

2. The construct of claim 1, wherein the matrix lath comprises a thickness between the front side and the back side of approximately ¼ inch or less.

3. The construct of claim 1, wherein the water channel layer comprises a thickness between the front side and the back side of approximately ¾ inch or less.

4. The construct of claim 1, wherein the water channel layer comprises a thickness between the front side and the back side of approximately ¼ inch or less.

5. The construct of claim 1, wherein the water channel layer is joined with the matrix lath via an adhesive.

6. The construct of claim 1, wherein the water channel layer is joined with the matrix lath via a plurality of fasteners.

7. The construct of claim 1, further comprising a scrim layer positioned between the matrix lath and the water channel layer.

8. The construct of claim 1, further comprising a plurality of spacers positioned between the matrix lath and the water channel layer.

9. The construct of claim 8, wherein the plurality of spacers is formed from a soft foamacious material.

10. The construct of claim 8, further comprising a scrim layer positioned between the matrix lath and the water channel layer, wherein the plurality of spacers is integrally formed with the scrim layer.

11. The construct of claim 10, wherein the plurality of spacers is positioned in a series of rows, wherein each row comprises two or more spacers laterally separated by a respective series of gaps, and wherein the series of gaps in a first row of spacers is vertically aligned with the spacers in a second row of spacers.

12. The construct of claim 11, wherein each gap in each respective series of gaps comprises a width that is less than a width of each spacer in the plurality of spacers.

13. A method of assembling a construct for drainage and structural support of a wall, the method comprising:

positioning a back side of a matrix lath in opposition to a front side of a water channel layer, wherein the matrix lath comprises a first plurality of filamentous elements arranged in a first direction and a second plurality of filamentous elements arranged in a second direction substantially perpendicular to the first direction, wherein the first plurality of filamentous elements and the second plurality of filamentous elements together form a surface having peaks and valleys, and wherein the water channel layer is formed from a matrix of randomly oriented, non-absorbent, fibrous elements that define a path for water passing through the water channel layer from a top to a bottom thereof; and joining the back side of the matrix lath with the front side of the water channel layer.

14. The method of claim 13, further comprising:

before joining the back side of the matrix lath with the front side of the water channel layer, positioning a plurality of spacers between the matrix lath and the water channel layer.

15. The method of claim 14, wherein joining the back side of a matrix lath with the front side of a water channel layer comprises:

bonding the back side of the matrix lath to a front side of each respective spacer in the plurality of spacers; and bonding the front side of the water channel layer to a back side of each respective spacer in the plurality of spacers.

16. The method of claim 15, wherein positioning the plurality of spacers between the matrix lath and the water channel layer comprises:

positioning a first row of spacers, laterally separated by a first series of gaps; and positioning a second row of spacers, laterally separated by a second series of gaps, wherein the second row of spacers is vertically separated from the first row of spacers, and wherein the spacers in the second row of spacers are aligned with the gaps in the first series of gaps.

17. The method of claim 16, wherein the first row of spacers is positioned such that a width of each gap in the first series of gaps is less than a width of each spacer in the second row of spacers.

18. A method of installing a construct for drainage and structural support of a wall, the method comprising:

trimming a section of the construct for drainage and structural support of the wall to a determined size, wherein the construct comprises:

a matrix lath having a front side, a back side, a first plurality of filamentous elements arranged in a first direction, and a second plurality of filamentous elements arranged in a second direction substantially perpendicular to the first direction, wherein the first plurality of filamentous elements and the second plurality of filamentous elements together form a surface having peaks and valleys; and a water channel layer having a front side and a back side, wherein the front side of the water channel layer is joined with the back side of the matrix lath, and wherein the water channel layer is formed from a matrix of randomly oriented, non-absorbent, fibrous elements that define a path for water passing through the water channel layer from a top to a bottom thereof;

placing the section of the construct on a building wall; and fastening the section of the construct to the building wall.

19. The method of claim 18, wherein the construct further comprises a plurality of spacers positioned between the matrix lath and the water channel layer, and wherein fastening the section of the construct to the building wall comprises:

driving a nail through the construct and into the building wall, wherein the nail is driven through one of the spacers in the plurality of spacers.

20. The method of claim 18, further comprising:

applying a cementitious material to the surface of the matrix lath.

* * * * *